US006153831A

United States Patent [19]

Weber et al.

[11] Patent Number: 6,153,831

[45] **Date of Patent: *Nov. 28, 2000**

[54] COMPOSITE INSULATOR WITH 3-DIMENSIONAL WEAVE OF S2 GLASS FIBERS AND EPOXY

[75] Inventors: Charles M. Weber; Timothy A. Antaya, both of Forest, Va.

[73] Assignee: BWX Technologies, Inc., Lynchburg, Va.

[ * ] Notice: This patent issued on a continued prosecution application filed under 37 CFR 1.53(d), and is subject to the twenty year patent term provisions of 35 U.S.C. 154(a)(2).

[21] Appl. No.: 08/899,995

[22] Filed: Jul. 24, 1997

Related U.S. Application Data

[63] Continuation of application No. 08/509,629, Jul. 31, 1995, abandoned.

[51] Int. Cl.[7] ..... H01B 17/32

[52] U.S. Cl. ..... 174/209; 174/138 C; 428/228; 428/902

[58] Field of Search ..... 174/209, 137 B, 174/138 C, 138 R, 137 R; 428/902, 225, 226, 228, 258

[56] References Cited

U.S. PATENT DOCUMENTS

| | | | |
|---|---|---|---|
| 5,021,281 | 6/1991 | Bompard et al. | 428/116 |
| 5,296,064 | 3/1994 | Muzzy et al. | 156/180 |

FOREIGN PATENT DOCUMENTS 4023386 1/1992 Japan .

OTHER PUBLICATIONS

T. N. Faddis et al., Development of Pseudohomogeneous Three–Dimensional, Continuously Woven Composite Material, Society of Automotive Engineers, National Business Aircraft Meeting, Wichita, KS, pp. 1–2, Mar. 1972.

Y. Murakami, International Symposium on New Developments in Applied Superconductivity, Suita, Osaka, Japan, all, Oct. 1988.

T. J. McManamy, Insulation Interlaminar Shear Strength Testing with Compression and Irradiation, Proceedings–IEEE Thirteenth Symposium on Fusion Engineering Part 1, Knoxville, TN, p. 1, Oct. 1989.

Funabashi, M. et al., Mechanical Properties of Hybrid Three Dimensional Fabrics Reinforced Epoxy resin Composites, Society for the Advancement of Material and Process Engineering, 1991, p. 663, Dec. 1991.

P. E. Fabian et al., Low Temperature Thermal Properties of Composite Insulation Systems, Proceedings of the Cryogenic Materials Conference, Nonmetallic Materials and Composites at Low Temperatures VII, 1994, Cryogenics 1995 vol. 35 No. 11, p. 719–720.

*Primary Examiner*—Jeffrey Gaffin
*Assistant Examiner*—Kamand Cuneo
*Attorney, Agent, or Firm*—Robert J. Edwards

[57] ABSTRACT

A composite insulation of S2 glass fibers and epoxy is formed having a more nearly uniform coefficient of thermal expansion in all three planes for use in cryogenic superconductor applications. The glass fibers have a three-dimensional weave.

4 Claims, No Drawings

COMPOSITE INSULATOR WITH 3-DIMENSIONAL WEAVE OF S2 GLASS FIBERS AND EPOXY

This is a continuation of application Ser. No. 08/509,629 filed Jul. 31, 1995 abandoned.

FIELD AND BACKGROUND OF THE INVENTION

This invention relates generally to the field of superconductors, and more specifically, the physical properties of the structural and insulating material used with superconductors, and in particular, the coefficient of thermal expansion of the material.

Glass reinforced epoxy insulation structures are often used in superconducting magnets. Large magnets using Cable-in-Conduit-Conductor (CICC) require insulation and structural support for the CICC turns.

The CICC conduit is chosen to match the CTE (Coefficient of Thermal Expansion) of the superconducting material. The superconducting material is a brittle intermetallic that is formed by reaction at high temperatures. The CICC provides support to the brittle superconducting material and an enclosure for cooling fluid which is necessary for superconducting performance. Too much strain imparted to the superconducting material will also degrade performance. The CICC conduit is chosen to match the thermal expansion of the superconducting material from the reaction temperature to room temperature for coil fabrication and to cryogenic (e.g. 5K) temperature for superconductor operation.

To provide structural support and insulation the CICC conduit is surrounded by the insulating material. Stresses are induced into the structure (CICC coil with turns surrounded by insulating material, glass roving and epoxy) by reaction of Lorentz forces when the coil is energized and upon cooldown of the structure due to the difference in thermal expansion between the insulating material and the CICC conduit, the geometry of the coil, and the anisotropic nature of the thermal coefficient of expansion and of the anisotropic nature of the strength and modulus of elasticity due primarily to the 2D nature of the composite material of the insulation. By 2D nature, it is meant that in the direction perpendicular to the warp-fill plane, the composite exhibits epoxy-like properties. These resulting stresses in the insulation are very large and will likely crack in operation.

For some projects, the existing insulation design (using the 2D composite support and insulation system given above) results in unacceptably large stresses which violate the design guidelines and requirements. This provides risk of structural and electrical degradation or failure. Given the expense of the magnets and the associated projects, risk reduction and improved reliability achieved with this design appears prudent.

SUMMARY OF THE INVENTION

An object of this invention is to avoid the problems associated with two dimensional insulating materials, such as unacceptable stresses in the plane perpendicular to the warp/fill plane caused by anisotropic coefficient of thermal expansion of the materials.

Accordingly, a primary object of the present invention is to provide a structural support and insulating material for superconductors that has a more nearly uniform coefficient of thermal expansion in all three planes.

A further object of the invention is to provide a material that will result in decreased stresses on the material and on other parts of a superconductor device upon cooldown to cryogenic temperatures.

A further object of the invention is to provide an insulating material that will not adversely affect the operation of the superconductor.

The various features of novelty which characterize the invention are pointed out with particularity in the claims annexed to and forming a part of this disclosure. For a better understanding of the invention, its operating advantages and specific objects attained by its uses, reference is made to the accompanying descriptive matter in which a preferred embodiment of the invention is illustrated.

DESCRIPTION OF THE PREFERRED EMBODIMENTS

The invention introduces a tailored isotropic insulation whose thermal expansion characteristics more closely resemble those of the CICC conduit with which it is to be used and whose mechanical properties are nearly isotropic. By providing an insulating material of nearly the same coefficient of thermal expansion as the CICC conduit and one that has nearly uniform coefficient of thermal expansion in all three directions, the stress in the insulation and the structure upon cooldown to cryogenic temperature from room temperature will be within acceptable limits. Also, the stresses are strongly affected by the isotropic nature of the glass fibers in the insulation matrix of the composite and their strength and modulus of elasticity. To obtain these isotropic coefficients of thermal expansion and mechanical properties, a three-dimensional (3D) weave of glass fibers is used so that the strength, modulus and expansion are more nearly the same in all directions.

In a 3D weave, warp fibers tie together more than one warp-fill plane. The glass and epoxy of the composition are chosen to provide the best match of coefficient of thermal expansion with that of the CICC conduit.

One choice of CICC conduit material that is used to demonstrate this invention, is Incoloy 908. This is used to match the $Nb_3Sn$ comprising the superconducting material. This combination is common in high performance or high field superconducting magnets.

The insulating material is also chosen so that the coefficients of thermal expansion most closely match those of the CICC conduit and the superconducting material, achieved by tailored 3-D properties. In this example, the insulating material to be used with the Incoloy 908 and $Nb_3Sn$ is S2 glass fiber with epoxy fill composed of CTD 101K. Alternatively, in another embodiment, there is used an initial KAPTON (a trademarked material) or polyimide layer warp with S2 glass fiber and epoxy fill. Also anticipated by this invention is a cruciform or T-shaped 3D woven corner roving designed to distribute the stress load around and through corners of the CICC while avoiding epoxy-rich regions.

While a specific embodiment of the invention has been described in detail to illustrate the application of the principles of the invention, it will be understood that the invention may be embodied otherwise without departing from such principles.

What is claimed is:

1. A method of using a three dimensional composite insulation with a cable-in-conduit-conductor material and a superconducting material, comprising:

selecting a three dimensional weave of S2 glass fibers and an epoxy fill having a substantially uniform coefficient of thermal expansion in three planes orthogonal that is substantially the same as the coefficient of thermal expansion of at least one of the cable-in-conduit-conductor material or the superconducting material; and insulating the cable-in-conduit-conductor material with the three dimensional weave of S2 glass fibers and epoxy.

2. A three dimensional composite insulation for a cable-in-conduit-conductor, the insulation comprising:

a three dimensional weave of S2 glass fibers;

an epoxy fill impregnating the three dimensional weave of S2 glass fibers having a weave so that the coefficient of thermal expansion of the epoxy impregnated three dimensional weave is substantially uniform in three planes orthogonal.

3. A three dimensional composite insulation according to claim 2, wherein the three-dimensional weave has a plurality of warp fibers, each warp fiber tying at least two warp-fill planes.

4. A three dimensional composite insulation according to claim 3, wherein the epoxy fill is CTD-101K.

* * * * *